US010512945B2

(12) United States Patent
Littleton

(10) Patent No.: US 10,512,945 B2
(45) Date of Patent: Dec. 24, 2019

(54) PROCESS AND APPARATUS FOR PERFORMING BUOYANT FORCED OSCILLATORY CLEANING

(71) Applicant: Nicholas Glen Littleton, Saratoga, CA (US)

(72) Inventor: Nicholas Glen Littleton, Saratoga, CA (US)

( * ) Notice: Subject to any disclaimer, the term of this patent is extended or adjusted under 35 U.S.C. 154(b) by 0 days.

(21) Appl. No.: 15/824,465

(22) Filed: Nov. 28, 2017

(65) Prior Publication Data

US 2018/0161826 A1 Jun. 14, 2018

Related U.S. Application Data

(60) Provisional application No. 62/434,170, filed on Dec. 14, 2016.

(51) Int. Cl.

| | |
|---|---|
| ***B08B 3/04*** | (2006.01) |
| ***F24C 15/20*** | (2006.01) |
| ***B08B 3/10*** | (2006.01) |

(52) U.S. Cl.
CPC ..... *B08B 3/047* (2013.01); *B08B 3/041* (2013.01); *B08B 3/102* (2013.01); *F24C 15/2021* (2013.01); *F24C 15/2057* (2013.01)

(58) Field of Classification Search
CPC combination set(s) only.
See application file for complete search history.

(56) References Cited

U.S. PATENT DOCUMENTS

2014/0137900 A1* 5/2014 Nicholas ..... B08B 3/102 134/34

* cited by examiner

*Primary Examiner* — Erin F Bergner
(74) *Attorney, Agent, or Firm* — Cozen O'Connor

(57) ABSTRACT

An open top tank assembly and process for performing forced immersion oscillatory cleaning of products, parts, assemblies or other materials with or without non-line of sight (NLOS) features, wherein the process is repeated during application of pressure gradients to the fluid in the tank to develop a consistent rhythmic oscillation that creates movement of product in a center cavity of the tank to repeatedly transfer the fluid through the product to clean the product.

8 Claims, 7 Drawing Sheets

PROCESS AND APPARATUS FOR PERFORMING BUOYANT FORCED OSCILLATORY CLEANING

CROSS-REFERENCE TO RELATED APPLICATIONS

This application claims priority from U.S. Provisional Application Ser. No. 62/434,170 filed Dec. 14, 2016, the content of which is hereby incorporated by reference in its entirety.

BACKGROUND OF THE INVENTION

1. Field of the Invention

The present invention relates to cleaning processes and, more particularly, to a cleaning or surface treatment process and associated tank assembly for implementing the process.

2. Description of the Related Art

It is known that the thorough cleaning of commercial kitchen exhaust hood filters and electrostatic precipitator cells is a difficult task with the conventional equipment solutions and best practices in the market place. Commercial kitchen exhaust hood filters, or hood filters, are designed such that the filter has areas of grease accumulation from the grease laden vapors of cooking that are not in a clear line of sight to operators of cleaning equipment. These non-line of site (NLOS) areas, or critical areas, of the filter are the primary area of shear in the aft flow as the grease laden vapor passes through the filter and subsequently are the areas that accumulate the most grease deposits. For hood filters to function properly, these critical areas need to be free from grease accumulation.

As hood filters accumulate grease, two things start to happen. First, the filter becomes less efficient and allows more grease vapors to pass through. This will in turn allow for more grease deposits to accumulate on the duct work and the exhaust fan that is usually on the roof of a restaurant. As grease deposits increase in the duct work and the fan, the efficiency of the entire exhaust system is compromised, and there is an increased fire hazard from the grease accumulation. Second, as grease accumulates in the critical area of a filter, the accumulated grease reduces the volume of aft that can be exhausted or removed from the kitchen. This will lead to cooking vapors/smoke accumulation in the kitchen and will impact the aft balance (e.g., make-up aft (MUA) or heating ventilation/air conditioning (HVAC)) of the facility. Both of these situations can be avoided with clean hood filters and proper cleaning protocols set forth by the restaurant or commercial kitchen.

Cleaning hood filters is a common activity for all commercial kitchens. The conventional methods of cleaning these hood filters is either laborious or ineffective. Manually cleaning the filters by hand is not a desirable duty and takes quite a bit of time to perform thoroughly. Many commercial kitchens that have industrial dishwashers place the filters in the dishwashers and run them through. While this process appears to clean the filter, it in fact does not thoroughly clean the filter. Due to the NLOS features of the filters, 1 and 2 degree sprays of commercial dishwashers cannot contact the critical area of the filter where the majority of the grease has accumulated. Hence, a filter will look clean to the eye, but will have hidden accumulation in the critical areas and will not perform as well as a completely clean filter. Many commercial kitchens will subcontract the cleaning of filters out to service organizations. These hood cleaning companies (HOC) utilize a couple of techniques to clean filters thoroughly. For example, many HCCs use caustic soak tanks. This process involves simply placing the filter in a bath of caustic water and allowing the caustic water to completely dissolve the grease. While effective in cleaning the filter, this process takes several hours or even days to work, and most HCCs do not have the time to waft on this process. Another exemplary process involves pressure washing. Here, the HCC uses a high pressure washer to spray the filters. This process is marginally effective but is very time consuming, and requires a large area to perform the work because of splashes caused by the high pressure spray. In order to clean a hood filter properly, the critical area of the filter must have all the grease removed. As previously mentioned, this critical area is not visible, hence the challenge of cleaning this area well.

It is also known that several other industrial cleaning applications, where NLOS issues persist, could be satisfied with this process and equipment solution. Some examples of this are complex castings or machined parts, which are becoming more common place with the advent of 3D scanning technology and advanced computer aided numerical controlled (NC) machining. Most complicated castings and machined parts need cleaning, and current spray booths or dunk tanks used in cleaning these parts have the same issues as hood filters. Spray booths only have for 2 degree spray trajectories and dunk tanks take many hours to work properly.

It is also known that several products need surface treatments on NLOS areas, such as acid etching or anodizing. The same issues of cleaning NLOS apply to surface treatment of NLOS. Sprays cannot see the feature and dunk tanks take a long time.

Also known is a fluids or other based process, where this forced immersion with oscillation process can be applied in a manner that acts not as a cleaning process, but as a process to achieve other objectives.

SUMMARY OF THE INVENTION

Disclosed is a cleaning or surface treatment process and associated tank assembly for implementing the process. The disclosed process is liquid based and can be used with, liquid solutions, such as aqueous caustic, biological (enzyme based or other), solvents and adds. Due to non-line of site (NLOS) processing, liquids may need to be forced or channeled to flow through the areas that cannot be seen. In accordance with the invention, the process is implemented by filling a rigid hollow cavity with air that resides below the product (hood filter, stack of filters or industrial part).

In accordance with the invention, the product is arranged directly above the rigid hollow cavity while being completely submerged in working fluid in a tank. As air is pumped into the rigid hollow cavity, a buoyant forces is created that causes the rigid hollow cavity and product to begin to float upward. This buoyant force translates into an upward force that lifts the rigid hollow cavity and product inside the tank that is filled with working fluid. As more air is pumped into the rigid hollow cavity, a buoyant force having an increasing magnitude is created. This force continues to lift the rigid hollow cavity and product until these components are restrained by a tether that is attached to the tank and the rigid hollow cavity. Once the tether is fully engaged, the pressure of the air filling the rigid hollow cavity increases until the air bursts (exits) from around the perimeter of the rigid hollow cavity, which causes the buoyant force in the rigid hollow cavity to significantly reduce in magnitude. With this reduction in force, the rigid hollow cavity and product drop within the tank. After the rigid hollow cavity is lowered within the tank, the air pressure and resulting buoyant force will start to build again, which will cause the rigid hollow cavity and product to lift until the tether is engaged and ultimately the air will burst (exit) from the rigid hollow cavity causing these components to again drop. With air continuously flowing into the rigid hollow cavity, a process of repetitive oscillation is established. This oscillation of the product within the tank forces working fluid through the SILOS areas which results in a cleaning action.

It should be noted the buoyant forced oscillation process in accordance with the invention is active. Consequently, the tank is connected to a pump that recirculates the working fluid from the bottom of the tank and into the top of the tank. This process amplifies the buoyant forced oscillation by adding a significant flow rate of working fluid through the product being cleaned.

While the buoyant force oscillation and a recirculation pump are activated, an additional agitation force is added. This agitation force is accomplished by attaching a mechanical, hydraulic, pneumatic or electrical, vibration inducer to the bottom of the rigid hollow cavity. While the buoyant force oscillation process is active, the rigid hollow cavity is not in contact with the bottom of the tank. As a result, a mechanical vibration inducer is avowed to transfer all its energy into the rigid hollow cavity and products being cleaned.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Various embodiments are disclosed in the following detailed description and the accompanying drawings, in which.

DETAILED DESCRIPTION OF THE EXEMPLARY EMBODIMENTS

The following detailed description of specific embodiments of the inventive subject matter will be better understood when read in conjunction with the appended drawings. As used herein, an element or step recited in the singular and proceeded with the word "a" or "an" should be understood as not excluding plural of said element(s) or step(s), unless such exclusion is explicitly stated. Furthermore, references to "embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1A:
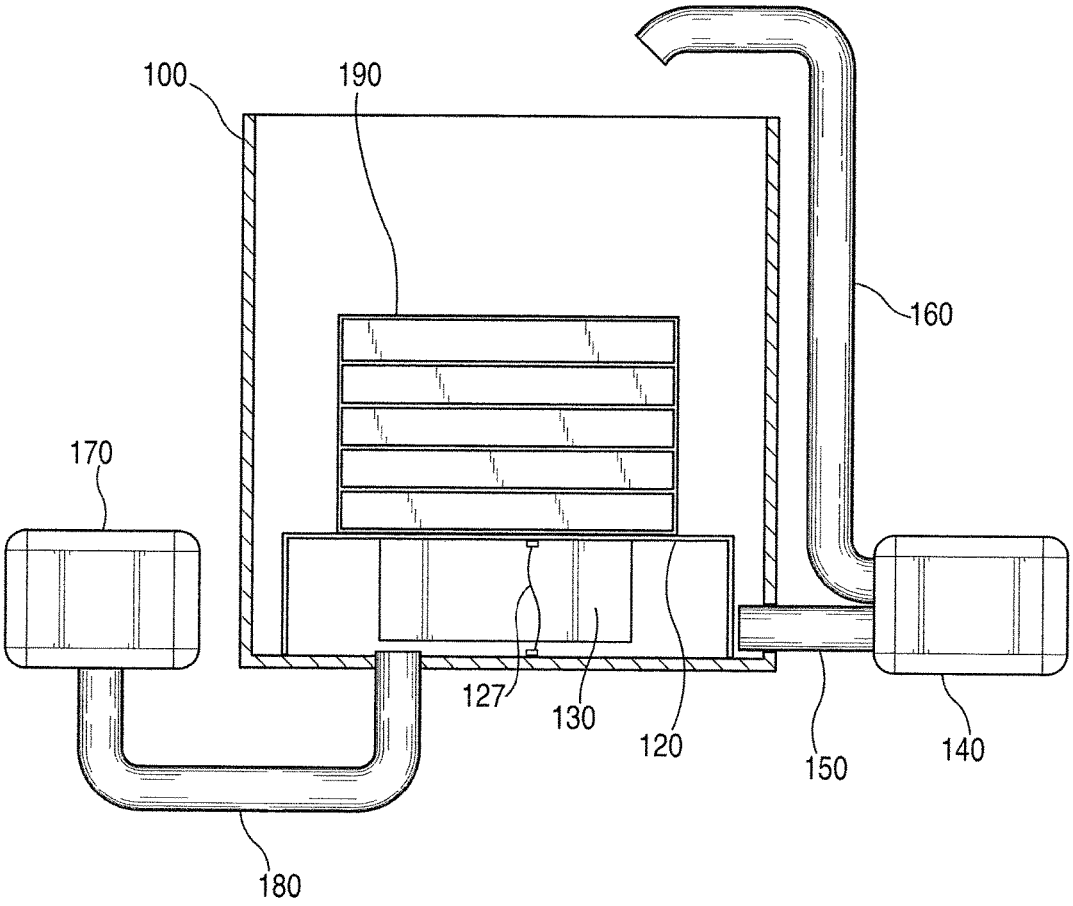
FIG. 1A is a cross-sectional side view depicting the major components of the cleaning tank in accordance with the invention.

FIG. 1A is a cross-sectional side view of an open top tank assembly that may be used as a device to clean or treat products, parts, assemblies or other materials with or without non-line of sight (NLOS) features in accordance with an embodiment of the invention. As shown in a cutaway side view of the device in FIG. 1A and top view FIG. 1B, a tank assembly includes a tank 100. The tank 100 can be made of but not limited to various plastics including polyethylene (FE) and high density polyethylene (HDPE) and various metals including stainless steel (SST). The rigid hollow cavity 120 is disposed at the bottom of the tank 100.

Figure 1B:
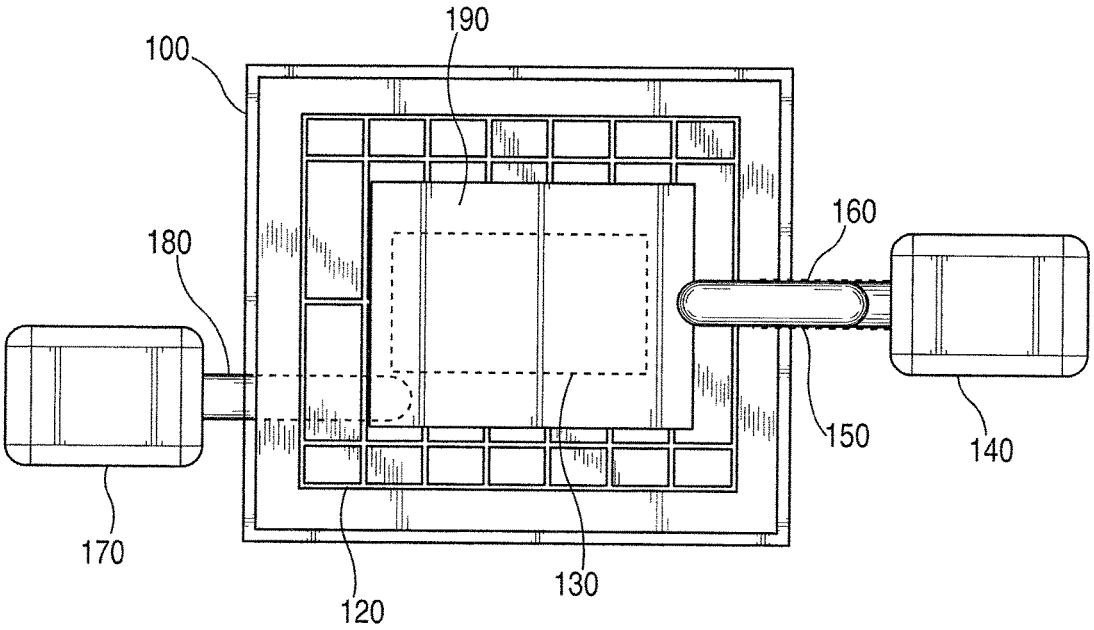
FIG. 1B is a top view of a cleaning tank and associated components of the cleaning tank.

With further reference to FIGS. 1A and 1B, attached to the rigid hollow cavity 120 is a vibration inducer 130. The vibration inducer 130 can be electrical, hydraulic or pneumatic in driven energy input. Arranged on top of the rigid frame 120 is the product 190 to be cleaned comprising one or several parts, assemblies or items with or without SILOS features. The product 190 can be placed on the rigid hollow cavity 120 directly as a free item or can be placed in a basket which can be placed on the rigid hollow cavity 120.

With further reference to FIGS. 1A and 1B, attached to the tank 100 is a high or low pressure air or gas feed hose 180. Air or gas flow rates and pressure can be regulated to provide a desired oscillation frequency. This air or gas hose 180 can be rigid or flexible and requires an air tight seal at the tank 100. Attached to the air or gas feed hose 180 is a pump 170, such as an air or gas pump or blower. In alternate embodiments, the pump is a squirrel cage blower, a rotary vane type pump, or other type of blower or pump. Air or gas flow rates and pressures of the pumps depend on the working gas and associated configurations of the tank 100. Attached to the tank 100, or other container of working fluid 200 (see FIG. 2A), is the working fluid suction pipe 150. This pipe is attached to the tank, such as in the lower areas of the tank 100, to ensure a submerged inlet port to the pipe. The suction pipe 150 is connected to a working fluid pump 140, such as a centrifugal, self-priming or other type of fluid transfer pump and could be made of a material such as SST, cast iron, composites or plastic. The working fluid pump 140 is connected to a return pipe 160 (see FIG. 2A) which transports the working fluid 200 (see FIG. 2A) from the pump 140 and feeds the top of the tank 100.

Turning to FIG. 1B, shown therein is a top view of the open top tank assembly in accordance with the disclosed embodiments of the invention. The rigid hollow cavity 120 is contained and sealed on the top and side surfaces to ensure air or working gas cannot escape when being filled with air or working gas.

Figure 2A:
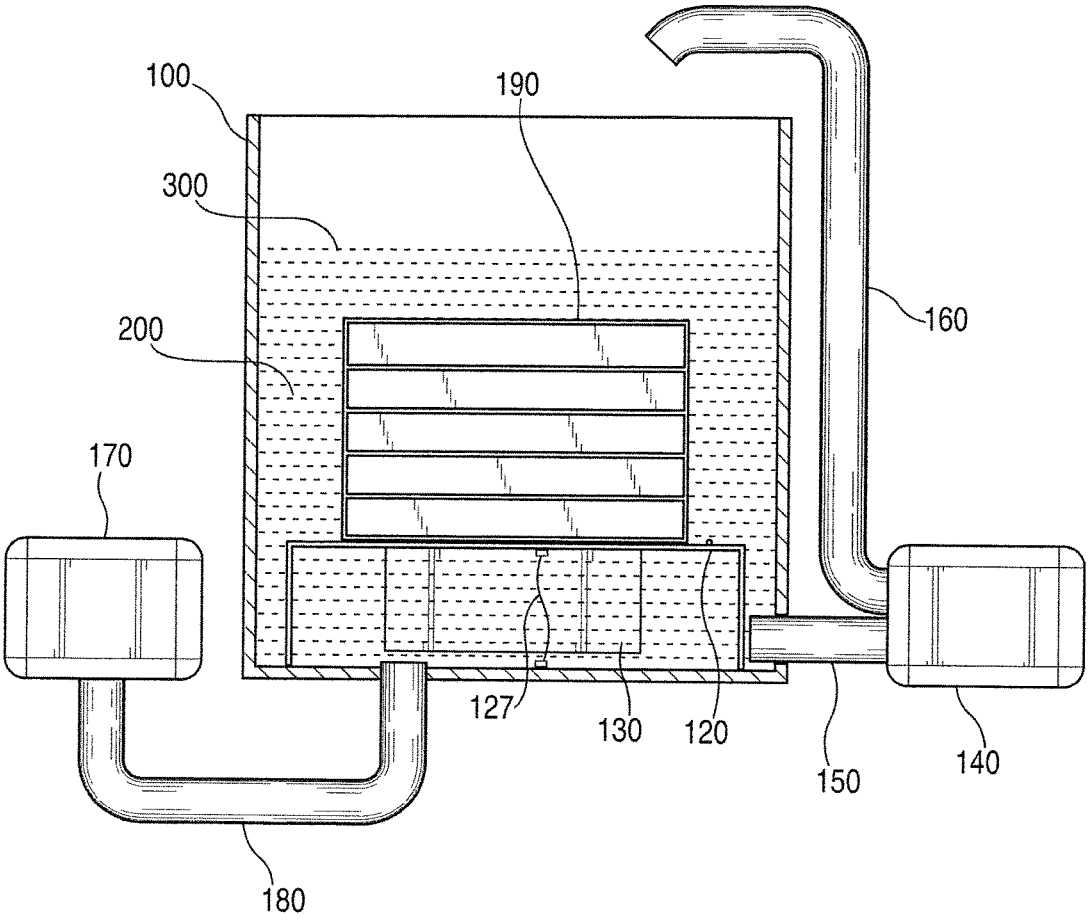
FIG. 2A is a side view of the cleaning tank of FIG. 1B with the associated components including working fluid which depicts the working fluid in a neutral state with no active pressurization of the rigid hollow cavity in accordance with an embodiment of the invention.

FIG. 2A is a side view of the tank 100 of FIG. 1A with the introduction of working fluid 200 into the tank 100. Here, the working fluid 200 fills the tank 100 and rigid hollow cavity 120 equally, with no air or working gas being released into the lower section of the tank 100 and under the rigid hollow cavity 120. In this state, the tether 127, which is securely connected to the bottom of the tank 100 and the rigid hollow cavity 120, is in a loose condition. Here, the working fluid 200 is shown filled to an operational working fluid level 300 that is consistent with the size of the tank 100 and amount of product 190 to be interacted with so that the product 190 is completely submerged.

Figure 2B:
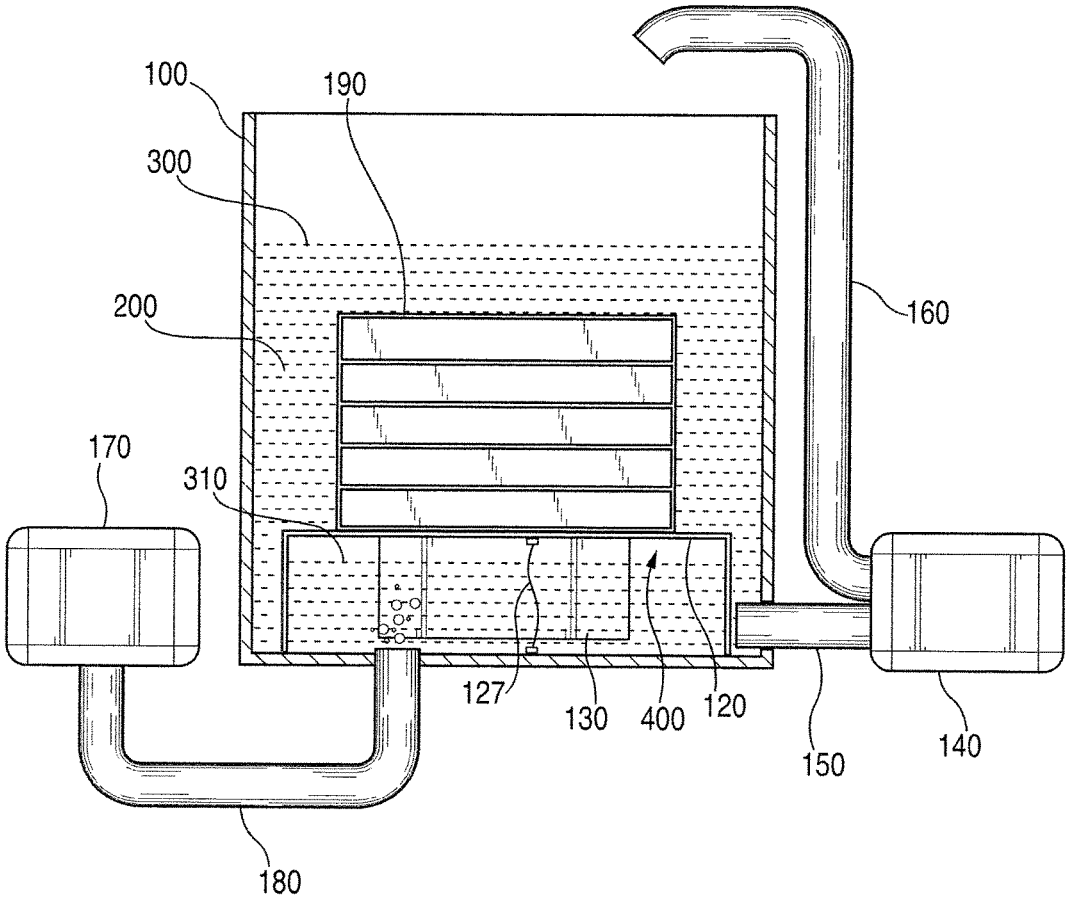
FIG. 2B is a side view of the cleaning tank of FIG. 1B with the associated components including the working fluid depicted in an initial state of pressurization with loose tether of the rigid hollow cavity.

FIG. 2B is a side view of the tank 100 of FIGS. 1A and 1B at the initial pressurization state of the rigid hollow cavity 120 achieved with the air or gas pump 170. This initial pressurization state creates a low pressure air gap 400 and low pressure cavity working fluid level 310. The low pressure air gap 400 within the rigid hollow cavity creates a buoyant force which lifts the rigid hollow cavity 120 and product 190. At this low pressure state, the tether 127 is still slack.

Figure 2C:
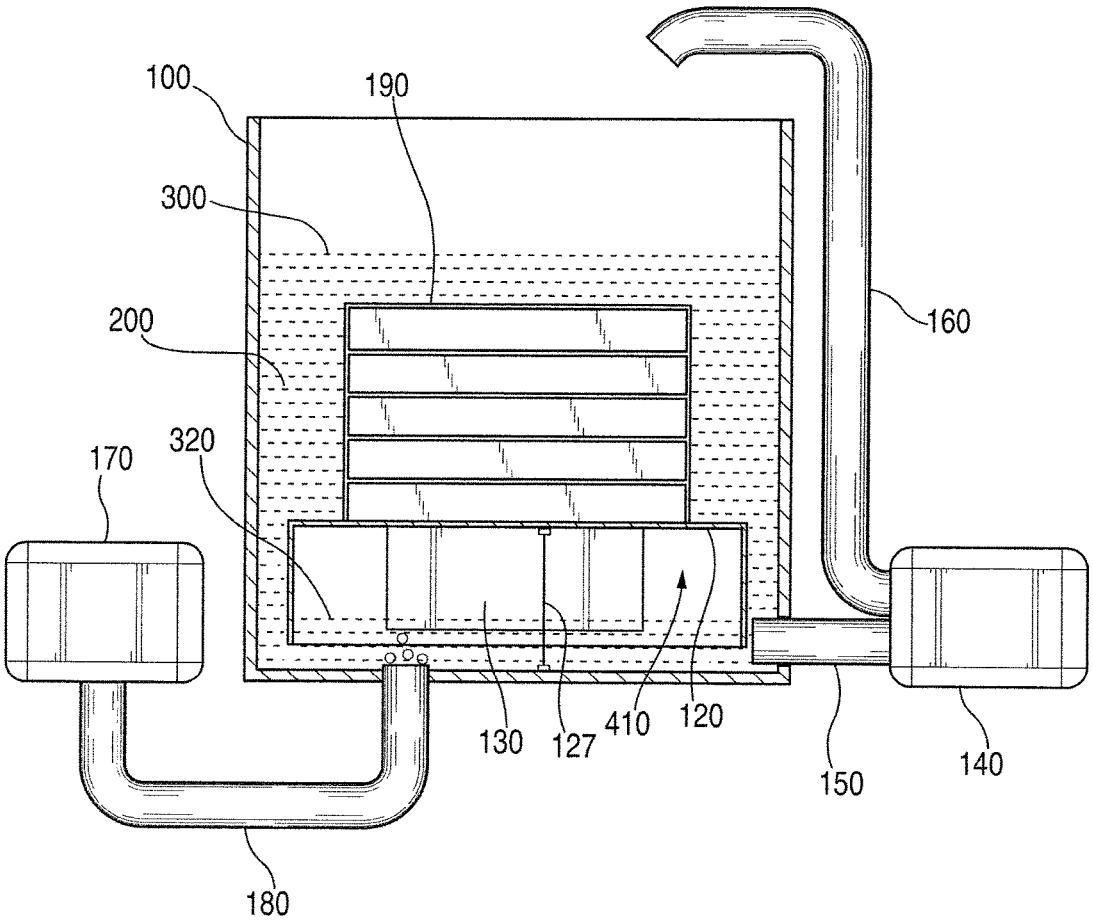
FIG. 2C is a side view of the cleaning tank of FIG. 1B with the associated components including the working fluid depicted in a high pressurization state with tight tether and high pressure rigid hollow cavity.

FIG. 2C is a side view of the tank 100 of FIGS. 1A and 1B at a high pressure state of the rigid hollow cavity 120 achieved with the air or gas pump 170. This high pressure state creates a high pressure air gap 410 and a high pressure cavity working fluid level 320. This pressure state creates a buoyant force capable of lifting the rigid hollow cavity 120, vibration inducer 130 and the product 190 such that the tether 127 becomes tight and restricts the height to which the rigid hollow cavity 120 and product 190 are lifted to the length of the tether 127.

Figure 2D:
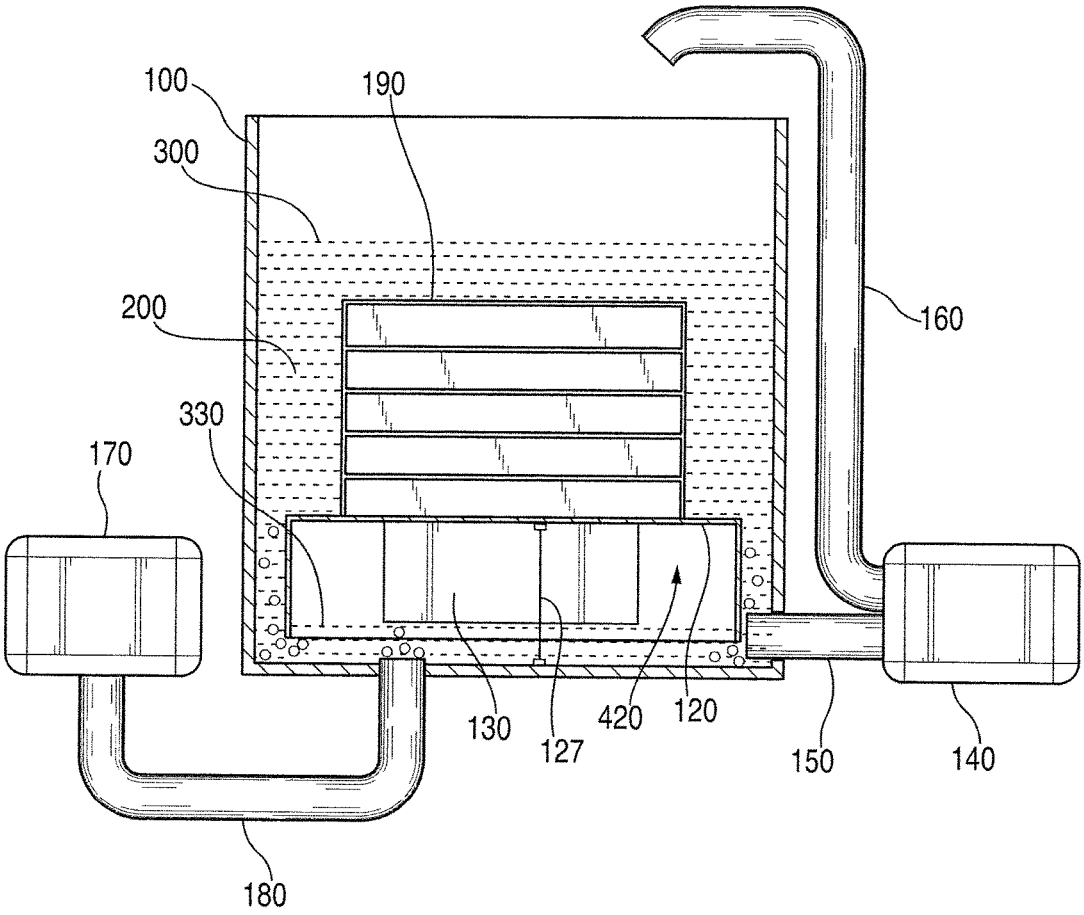
FIG. 2D is a side view of the cleaning tank of FIG. 1B with the associated components including the working fluid depicted in burst pressurization state, with the tight tether and burst pressure state of rigid hollow cavity in elevated position.

FIG. 2D is a side view of the tank 100 of FIGS. 1A and 1B at a burst pressure state of the rigid hollow cavity 120 achieved with the aft or gas pump 170. This burst pressure state creates a burst pressure aft gap 420 and a burst pressure cavity working fluid level 330. The burst pressure working fluid level 330 is equivalent with the bottom, or open end, of the rigid hollow cavity. In this state, the aft or gas within the rigid hollow cavity 120 escapes and bubble to the operational tank fluid level 300. When this escape occurs, the pressure in the rigid hollow cavity 120 is reduced and results in the low pressure air gap 400 shown in FIG. 2B. In this state, the rigid hollow cavity, vibration inducer 130 and product 190 will become lowered within the tank 100 and the tether becomes slack which embodies the state of the device, as shown in FIG. 2B.

The function of this process is observed by the rigid hollow cavity 120, vibration inducer 130 and product 190 transferring between the low, high and burst pressure states depicted in FIGS. 2B, 2C and 2D, respectively. This process is continuous and establishes a buoyant force oscillatory movement of the rigid hollow cavity 120, vibration inducer 130 and product 190 within the tank 100 filled with working fluid 200. This buoyant force oscillation transfers working fluid through the NLOS areas of the product 190.

During the buoyant force oscillation, the vibration inducer 130 is activated. This vibration creates mechanical agitation of the rigid frame 120 and product 190. During the buoyant force oscillation, the rigid hollow cavity 120, vibration inducer 130 and product 190 are suspended from the bottom of the tank 100, which allows transference of all the mechanical force of the vibration inducer 130 into the product 190 directly without wasting mechanical vibration energy of the entire tank 100.

In accordance with disclosed embodiments of the invention, during the buoyant force oscillation, the working fluid pump 140 recycles the working fluid 200 from the bottom of the tank 100 to the top of the tank 100. The working fluid is suctioned with the suction pipe 150 and discharged into the tank 100 with the discharge pipe 160.

Figure 3:
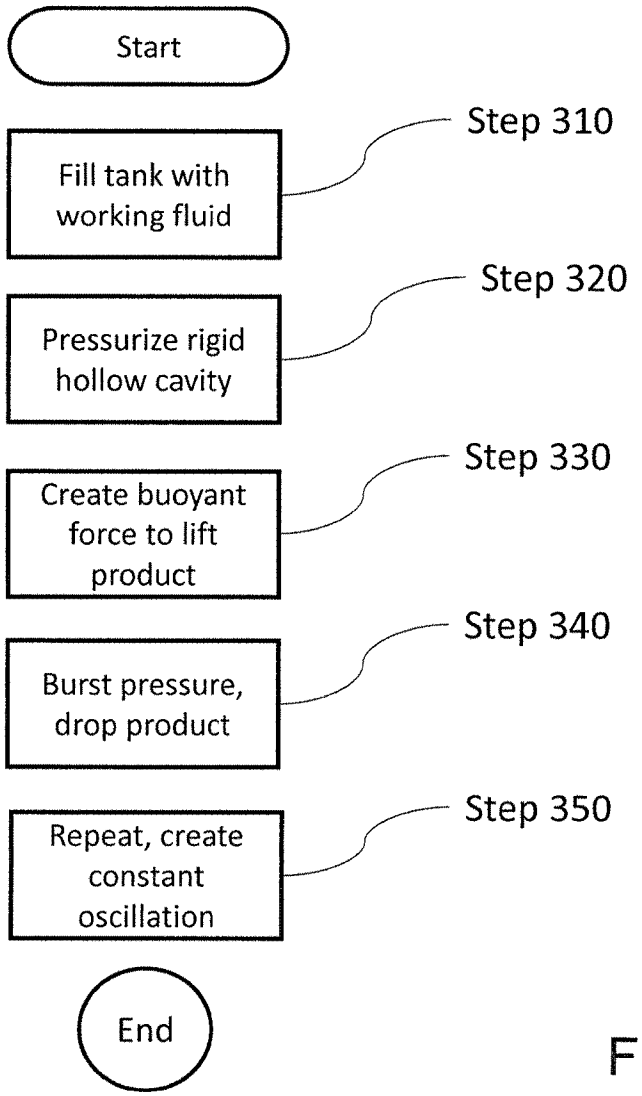
FIG. 3 is a flowchart of the process in accordance with the invention.

FIG. 3 is a flowchart of the process in accordance with the invention. The method comprises filling the tank with a fluid, as indicated in step 310. The tank includes a rigid hollow cavity 120 that is tethered to the bottom of the tank and receives product to be cleaned in the fluid.

Next, pressurized air or gas is applied to the rigid hollow cavity 120 at a first pump 170 in communication with the tank 100 via a first hose 180 to cause the rigid hollow cavity 120 to achieve an increase in pressure level, as indicated in step 320. Air or gas pressure is continuously applied within the rigid hollow cavity 120, which forces working fluid 200 out of the rigid hollow cavity 120 and creates an increase of the pressure level. This air or gas pressure will create a corresponding buoyant force that acts to lift the rigid hollow cavity 120 and product 190 that is submerged in the tank 100, as indicated in step 330. Applying the air or gas pressure in this manner causes the air or gas to be discharged from the lower rim area of the rigid hollow cavity 120. This discharge or burst of air or gas significantly drops the pressure of air or gas under the rigid hollow cavity 120 and reduces the buoyant force accordingly which causes the rigid hollow cavity 120 and product to lower within the tank, as indicated in step 340. The process is repeated during buoyant force fluctuations to develop a consistent rhythmic oscillation that creates movement of the rigid hollow cavity 120 and product 190 within the tank to repeatedly transfer the fluid 200 through the product to clean the product, as indicated in step 350.

While there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A process for performing buoyant force oscillatory cleaning of product arranged in a tank, a rigid hollow cavity being arranged at a bottom of the tank and submerged by fluid during cleaning of the product, the method comprising:

filling the tank with the fluid;

applying pressurized air or gas under the submerged rigid hollow cavity via a first hose in communication with the fluid to cause an increased pressure and buoyant force under the submerged rigid hollow cavity;

applying continued air or gas pressure to the rigid hollow cavity to increase the pressure and to create an increased buoyant which causes the rigid hollow cavity and product to rise within the tank to a point at which, a tether attached to the tank and the rigid hollow cavity, becomes taut so as cause to rigid hollow cavity and product to stop rising, said pressure being continually increased with the rigid hollow cavity constrained from further vertical movement by the tether such that the air or gas bursts from the rigid hollow cavity, a pressure within the rigid hollow cavity and a level of the buoyant force being substantially reduced when said burst occurs such that the rigid hollow cavity and product are lowered with the tank; and repeating the process during pressure gradient, fluctuations to develop a consistent rhythmic oscillation which creates movement of the rigid hollow cavity and product at a center cavity of the tank to repeatedly transfer the fluid through the product to clean said product.

2. The method of claim 1, further comprising:

recirculating the fluid from the bottom of the tank into the top of the tank via a second pump in communication with the fluid via an inlet suction pipe fixedly attached to the tank at a lower area to submerge the inlet suction pipe in the fluid, the second pump having a return pipe extending to the upper open perimeter of the tank for returning the fluid to tank.

3. The method of claim 1, further comprising:

applying a mechanical, vibrational force to the rigid hollow cavity via a vibration inducer fixedly attached to the rigid frame.

4. The method of claim 1, wherein the vibration inducer is one of electrical, hydraulic and pneumatic in driven energy input.

5. The method of claim 1, wherein the first hose is a high or low pressure air or gas feed hose and is sealed at the tank in an air tight manner.

6. The method of claim 1, wherein the first pump is an air or gas pump or blower.

7. The method of claim 1, wherein the first pump is one of a squirrel cage blower, a rotary vane type pump and a root pump.

8. The method of claim 2, wherein the second pump is one of a centrifugal pump and a self-priming pump.

* * * * *